US007378924B2

(12) United States Patent
Koizumi et al.

(10) Patent No.: US 7,378,924 B2
(45) Date of Patent: May 27, 2008

(54) FILTER WITH IMPROVED CAPACITIVE COUPLING PORTION

(75) Inventors: Daisuke Koizumi, Zushi (JP); Kei Satoh, Yokosuka (JP); Shoichi Narahashi, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 0 days.

(21) Appl. No.: 11/046,942

(22) Filed: Feb. 1, 2005

(65) Prior Publication Data

US 2005/0206481 A1 Sep. 22, 2005

(30) Foreign Application Priority Data

Feb. 3, 2004 (JP) ..... 2004-026539

(51) Int. Cl.

| | |
|---|---|
| ***H01P 1/20*** | (2006.01) |
| ***H01P 3/08*** | (2006.01) |
| ***H01P 5/12*** | (2006.01) |
| ***H01P 7/08*** | (2006.01) |

(52) U.S. Cl. ..... 333/204; 333/134; 333/219

(58) Field of Classification Search ..... 333/134, 333/204, 205, 219

See application file for complete search history.

(56) References Cited

U.S. PATENT DOCUMENTS 5,750,473 A 5/1998 Shen
6,166,612 A * 12/2000 Tsujiguchi ..... 333/204

FOREIGN PATENT DOCUMENTS

| | | | |
|---|---|---|---|
| EP | 0 068 345 A1 | | 1/1983 |
| EP | 0 858 121 | | 8/1998 |
| JP | 58-6601 | | 1/1983 |
| JP | 61-189701 | | 8/1986 |
| JP | 03-085903 | | 4/1991 |
| JP | 10-150302 | | 6/1998 |
| JP | 10200311 | * | 7/1998 |
| JP | 10-284901 | | 10/1998 |
| JP | 2000-349504 | | 12/2000 |

(Continued)

OTHER PUBLICATIONS

Hideyuki Suzuki, et al., "A Low-Loss 5 GHz Bandpass Filter Using HTS Quarter-Wavelength Coplanar Waveguide Resonators", IEICE Trans. Electron., vol. E85-C, No. 3, Mar. 2002, pp. 714-719.

(Continued)

*Primary Examiner*—Robert J. Pascal
*Assistant Examiner*—Kimberly E Glenn
(74) *Attorney, Agent, or Firm*—Oblon, Spivak, McClelland, Maier & Neustadt, P.C.

(57) ABSTRACT

A filter is provided which comprises a single dielectric, and a line conductor and a ground conductor disposed on the dielectric. The line conductor includes first and second line conductor sections having opposed portions defining an open gap therebetween to form a capacitive coupling section. The edge lines of the opposed portions of the first and second conductor sections defining the open gap therebetween are substantially elongated relative to the line width of the corresponding conductor sections. The thus constructed filter is capable of suppressing a variation in the normalized J-inverter value even if dimensional errors relative to the design specifications due to overetching or underetching involved during the manufacture.

3 Claims, 13 Drawing Sheets

FOREIGN PATENT DOCUMENTS

| | | |
|---|---|---|
| JP | 2000-357903 | 12/2000 |
| SU | 1290439 | 2/1987 |

OTHER PUBLICATIONS

Hideyuki Suzuki, et al., "Design of 5Ghz 10-pole Bandpass Filters Using Quarter-Wavelength Coplanar Waveguide Resonators", IEICE, Technical Report of IEICE, SCE2002-9, MW2002-9, Apr. 2002, pp. 45-50. (with English Abstract).

Zhewang MA, et al., "Design of a Novel Compact Interdigital Bandpass Filter Using Coplanar Quarter-Wavelength Resonators", IEICE, Technical Report of IEICE, SCE2003-12, MW2003-12, Apr. 2003, pp. 67-72. (with English Abstract).

Zhewang MA, et al, "A Low-Loss 5GHz Bandpass Filter Using HTS Coplanar Waveguide Quarter-Wavelength Resonators", IEEE MTT-S International Microwave Symposium, vol. 3 of 3, XP-001113984, Jun. 2, 2002, p. 1967-1970.

Eric Rius, et al., "Wide- and Narrow-Band Bandpass Coplanar Filters in the W-Frequency Band", IEEE Transactions on Microwave Theory and Techniques, vol. 51, No. 3, XP-001144810, Mar. 2003, pp. 784-791.

Zhou Xia, et al., "An Accurate and Fast Simulated Model of CPW Discontinuities", International Journal of Infrared and Millimeter Waves, vol. 24, No. 1, XP-001161361, Jan. 2003, pp. 55-60.

* cited by examiner

FIG.1 BACKGROUND ART

FILTER WITH IMPROVED CAPACITIVE COUPLING PORTION

BACKGROUND OF THE INVENTION

1. Field of the Invention

This invention relates to a filter used mainly in microwave and millimeter bands, which is constructed using a coupled transmission line system including a capacitive coupling section.

2. Prior Art

The prior art coupled transmission line system 10 including a capacitive coupling sections 11 at the input and output ends in a filter comprising series arranged half wavelength (λ/2) or quarter wavelength (λ/4) resonators utilizing a conventional coplanar line is described taking the coupling section 11-1 at the input end of the filter as shown in FIG. 1 as an example. Such coupled transmission line system 10 comprises a pair of ground conductors 13 and a line conductor 14 formed on a dielectric substrate 12, the line conductor 14 being disposed between the ground conductors 13 and including a line conductor section 14-1 on the input port side and an opposedly facing line conductor section 14-2 of a first resonator having a certain characteristic impedance, the opposed ends of the two line conductor sections being separated by a meander-like inter-digital gap. It has heretofore been a common practice to use a structure having a meander-like gap with very small gap widths g1, g2 as compared to the gap width g0 at the capacitive coupling section 9-2 (see FIG. 2) between the resonators.

Examples of the filter utilizing such construction include the λ/4 resonator coplanar line filter as disclosed in a non-patent literature 1-A: H. Suzuki, Z. Ma, Y Kobayashi, K. Satoh, S. Narahashi and T. Nojima, "A low-loss 5 GHz bandpass filter using HTS quarter-wavelength coplanar waveguide resonators," IEICE Trans. Elect., Vol. E85-C, No. 3, pp. 714-719, March 2002 and a non-patent literature 1-B: Suzuki, Ma, Kobayashi, Satoh, Narahashi and Nojima, "Design of 5 GHz 10-pole Bandpass Filters Using Quarter-Wavelength Coplanar Waveguide Resonators," Technical Report of IEICE, SCE2002-9, MW2002-9, pp. 45-50, April 2002 and the compact inter-digital bandpass filter using coplanar quarter-wavelength resonators as disclosed in a non-patent literate 2: Ma, Nomiyama, Kawaguchi and Kobayashi, "Design of Compact Inter-digital Bandpass Filter Using Coplanar Quarter-Wavelength Resonators," Technical Report of IEICE, SCE2003-12, MW2003-12, pp. 67-72, April 2002.

The four-stage λ/4 resonator coplanar line filter 8 disclosed in the non-patent literature 1-A and 1-B is shown in FIG. 2 in which the reference numeral 11-1 indicates a conventional capacitive coupling section as shown in FIG. 1 which is used at the input end of the filter. Indicated by 9-6, 9-7, 9-8 and 9-9 are four stage resonators, the first and second resonators and the third and fourth resonators being coupled by inductive coupling sections 9-3 and 9-4, respectively while the second and third resonators are coupled by a capacitive coupling section 9-2. The fourth resonator and a line conductor section 14-4 on the output port side are coupled by a conventional capacitive coupling section 11-2 as shown in FIG. 1 as is the case with the input end. It is to be noted that in FIG. 2 the parts that are similar to like parts in FIG. 1 are indicated by like reference numerals. Further, the capacitive coupling section 9-2 for coupling the second and third resonators will be referred to as capacitive resonator coupling section herein-below in order to discriminate it from the capacitive coupling sections 11-1, 11-2 for the input and output ends.

SUMMARY OF THE INVENTION

In the conventional filter 8 shown in FIG. 2, capacity of coupling for the capacitive coupling sections 11 at the input and output ends were required to have a coupling capacity greater by as many as 10 times than that of the capacitive resonator coupling section 9-2 (see FIG. 2) between the resonators. Therefore, the width of this open gap, namely a distance between the opposed ends of two line conductor sections, should be reduced to less than about one-tenth of the width of the line conductor because the meander-like open gap as shown in FIG. 1 was used. Consequently, if there are dimensional errors in the manufacture of opposed end portions of the two line conductor sections defining the open gap therebetween, the amount of variation in the electrical characteristics relative to the amount of variation in the gap width tends to be very large, so that there will occur a large degradation in the electrical characteristics due to dimensional errors that may take place during the manufacture of actual coupled transmission line systems or filters. By way of example, if there occurs a dimensional error of ±4 μm on the conventional coupled transmission line system shown in FIG. 1, there would be a variation on the order of 8 to 9% in the electrical characteristics, and if there occurs a dimensional error of ±8 μm, the variation in the electrical characteristics would amount to the order of 14 to 21% (see the dotted curves representing the prior art example in FIG. 3). These are variations of a very high magnitude. Accordingly, such coupled transmission line systems and filters constructed using such transmission line systems had the disadvantage of requiring extremely high manufacturing precision in order to obtain the characteristics for satisfying the design specifications.

In view of the problems with the prior art discussed above, an object of the present invention is to insure firmness of high-frequency characteristics against dimensional errors involved in the production of filters.

In order to accomplish the foregoing objects, according to the invention as set forth in claim 1, a filter is provided which comprises a dielectric, a line conductor and a ground conductor disposed in opposing relation to each other with the dielectric interposed therebetween, characterized in that the line conductor includes first and second line conductor sections opposedly disposed and separated by an open gap to form a capacitive coupling section, and that the edge lines of the opposed portions of the first and second conductor sections defining the open gap therebetween are substantially elongated relative to the line width of the corresponding conductor sections.

In the invention as set forth in claim 2, the capacitive coupling section is used at each of the input and output ends of the filter of claim 1.

The Effects of the Invention:

The coupled transmission line system according to the present invention provides advantages of enhancing the firmness against dimensional errors of normalized J-inverter value which is a design parameter for a coupled transmission line system and of reducing degradation of the filtering characteristics due to dimensional errors of a filter constructed by the use of the coupled transmission line system.

BEST MODES FOR CARRYING OUT THE INVENTION

Figure 4A:
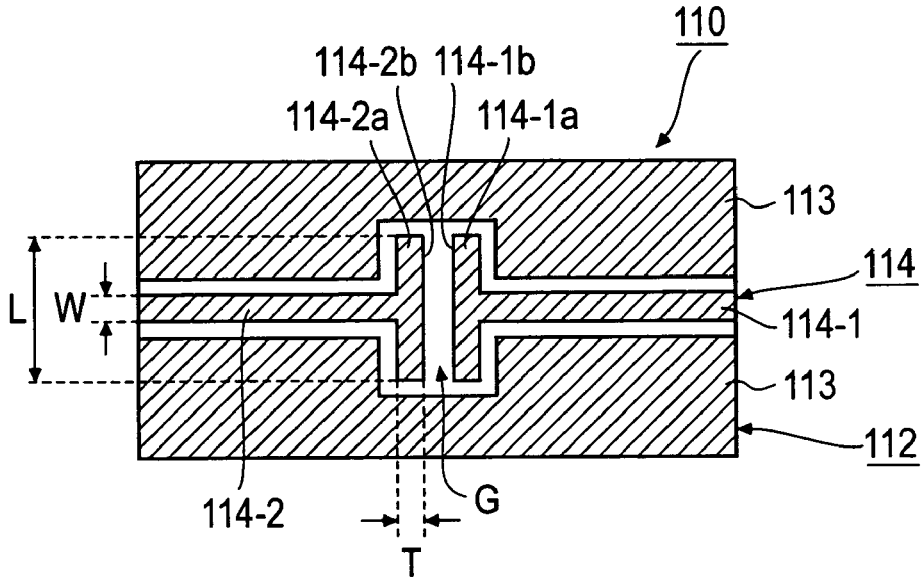
FIG. 4A is a view showing a first example of the coupled transmission line system according to the present invention in which each of the opposed end portions of the coupled line conductor sections is formed in a rectangular shape.

With regard to the invention set forth in claim 1, while various types of coupled transmission line systems for use at input and output ends of a filter may be envisaged, the coupled transmission line system which is applied to a coplanar line is shown as a first example in FIG. 4A. This coupled transmission line system 110 comprises a single dielectric substrate 112, and a pair of ground conductors 113 and a line conductor 114 both formed on the dielectric substrate. The line conductor 114 includes first and second line conductor sections 114-1 and 114-2 having opposed end portions 114-1*a* and 114-2*a* opposing and spaced from each other to define an open gap section G therebetween. The length L of the transverse edge lines 114-1*b* and 114-2*b* of the opposed end portions of the line conductor sections separated by the open gap section G are increased relative to the line width W of the corresponding line conductor sections 114-1 and 114-2 and are accordingly configured in the shape of a rectangle having a lengthwise dimension T in longitudinal direction of the line conductor and a widthwise dimension L in transverse direction of the line conductor.

Figure 1:
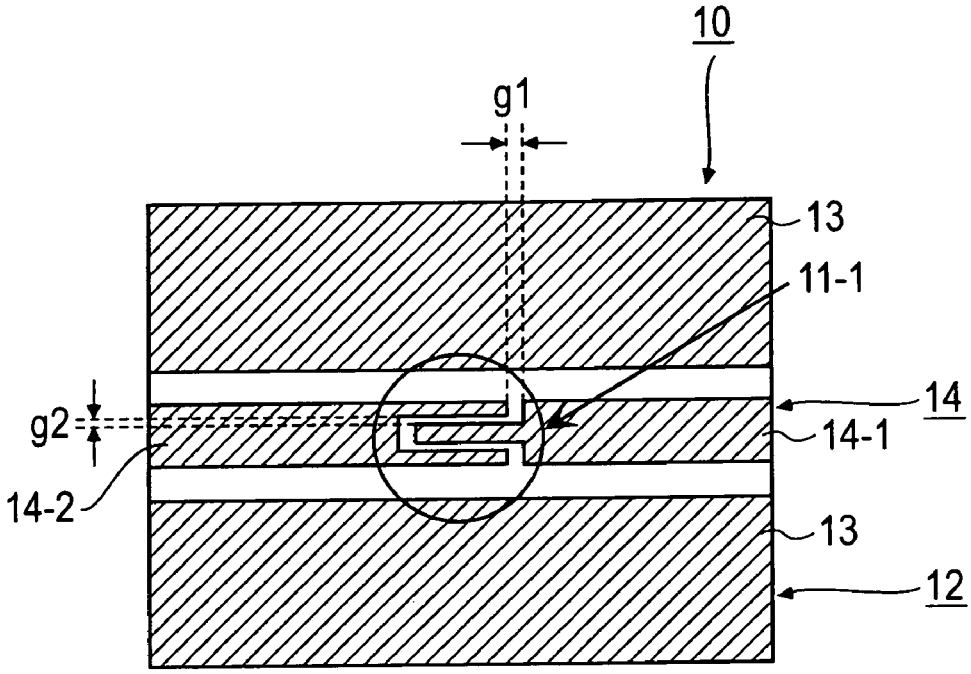
FIG. 1 is a view showing an example of the prior art coupled transmission line system having a meander-like gap between the two coupled line conductor sections.
Figure 3:
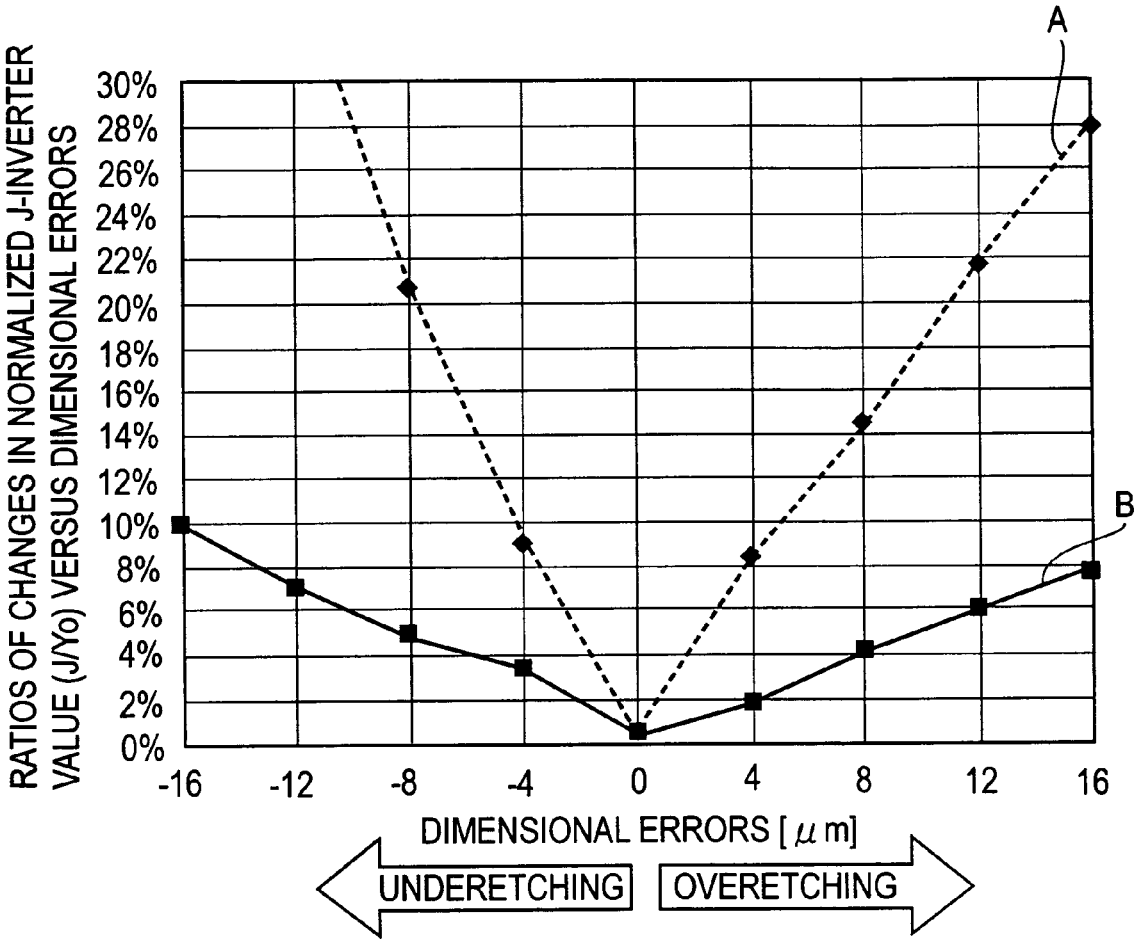
FIG. 3 is a graph showing the variations in the inverter value of the coupled transmission line system of the prior art and that of the present invention versus the dimensional errors involved during the manufacture.

FIG. 3 is a graph showing the results of the evaluations and comparison of the effects exerted on the electrical characteristics by dimensional errors between this coupled transmission line system 110 and the prior art coupled transmission line system 10 illustrated in FIG. 1. In this graph, with these capacitive coupled transmission line systems taken as admittance inverters (J inverters), the ratios (%) of changes in the normalized J-inverter value (J/Yo) due to dimensional errors of the two transmission line systems are shown as the calculation results based on an electromagnetic field analysis simulation.

From this graph it is noted that if there occurs a dimensional error of 8 μm, for instance, with respect to the design specifications due to overetching during the manufacturing process, in the conventional coupled transmission line system the normalized J-inverter value varies by as much as over 14% whereas in the coupled transmission line system according to the present invention the normalized J-inverter value varies by as little as slightly less than 4%. That is, the variation in the J-inverter value in the present invention (note the curves B in FIG. 3) is suppressed to less than one-third the variation in the prior art coupled transmission line system (note the curves A in FIG. 3).

Likewise, if there occurs a dimensional error of −8 μm with respect to the design specifications due to underetching during the manufacturing process, the prior art coupled transmission line system exhibits a variation in the normalized J-inverter value by as much as over 21% whereas in the coupled transmission line system of the present invention the normalized J-inverter value varies by as little as slightly under 5%, which means that the variation is suppressed to less than one-fourth the variation in the prior art. This represents an even better improvement than in the variation ascribable to the overetching.

It is thus to be appreciated that the firmness of the coupled transmission line system according to this invention against dimensional errors is very high as compared to the prior art coupled transmission line system.

While the foregoing description deals with an example of the application of the invention to the coplanar line, the application to another type of the coplanar line or a microstrip line will be described below.

Figure 4B:
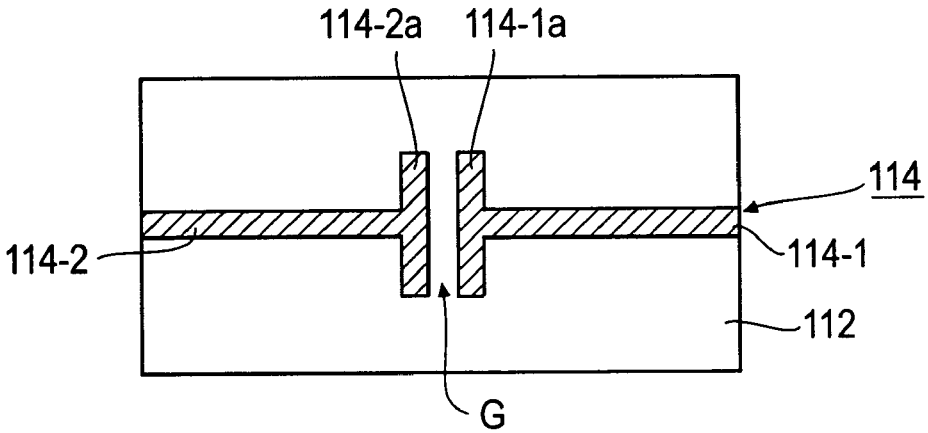
FIG. 4B is a view showing a different application of that system.

FIG. 4B shows an instance in a plan view in which the configuration shown in FIG. 4A is embodied in the form of a microstrip line. In FIG. 4B the parts that are similar to like parts in FIG. 4A are indicated by like reference numerals and character. In this case, the ground conductor 113 (not shown) is disposed on the back side of the dielectric substrate 112.

Figure 5A:
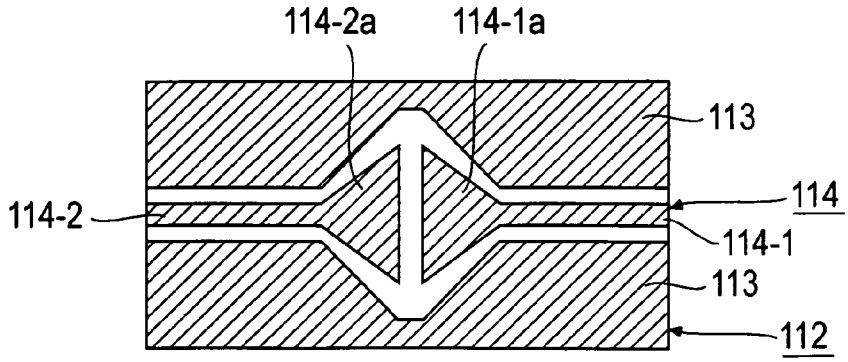
FIG. 5A is a view showing a second example of the coupled transmission line system according to the present invention in which each of the opposed line conductor sections has a divergent (inversely tapered) end portion adjacent the open gap.

FIG. 5A shows a modified form of the coupled transmission line system, as a second example, which is applied to a coplanar line like the example of FIG. 4A. In FIG. 5A the parts that are similar to like parts in FIG. 4A are indicated by like reference numerals and character. The opposed end portions in this second example have a divergent or inversely tapered shape such that their width increases widthwise of the line width progressively as they are closer to the open gap section G longitudinally of the line conductor. This configuration, where it is applied to a coplanar line, allows for realizing a coupled transmission line system having a high matching property since it is capable of maintaining the characteristic impedance of the line conductor in the divergent end portions as well.

Figure 5B:
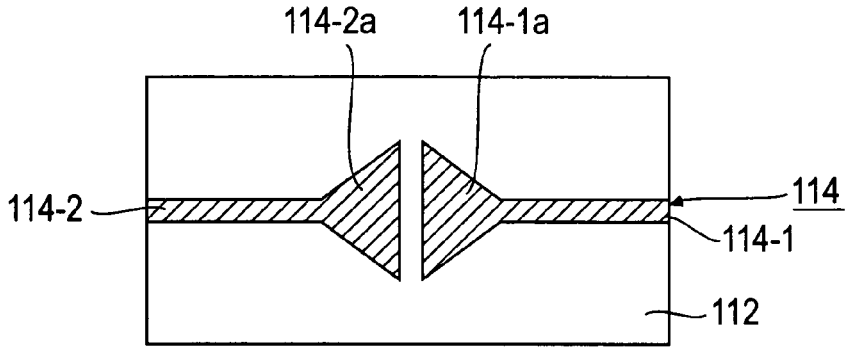
FIG. 5B is a view showing a different application of that system.

FIG. 5B is a plan views showing the instance in which the configuration of FIG. 5A is applied to a microstrip line.

Figure 6A:
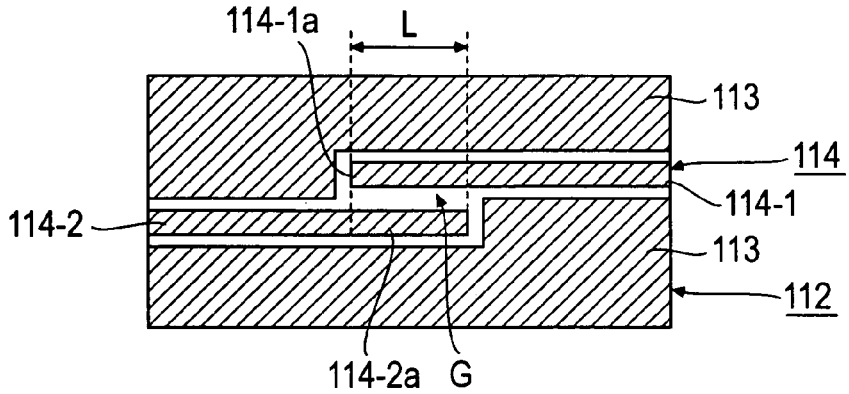
FIG. 6A is a view showing a third example of the coupled transmission line system according to the present invention in which the opposed portions of the line conductor sections overlap each other in closely spaced parallel relationship.

FIG. 6A illustrates another modified form of the coupled transmission line system, as a third example, which is applied to a coplanar line. In FIG. 6A the parts that are similar to like parts in FIG. 4A are indicated by like reference numerals and character. In this third example, the two line conductor sections 114-1 and 114-2 being coupled are positioned such that they partly overlap each other in closely spaced parallel relationship to define opposed end portions 141-1*a* and 141-2*a* having a length L longitudinal of the line conductor. The opposed end portions 141-1*a* and 141-2*a* are little increased in width transverse of the coupled line conductor sections, but the length L of the edge lines defining the open gap section G is made greater than the line width W whereby an increased coupling capacity may be insured.

Figure 6B:
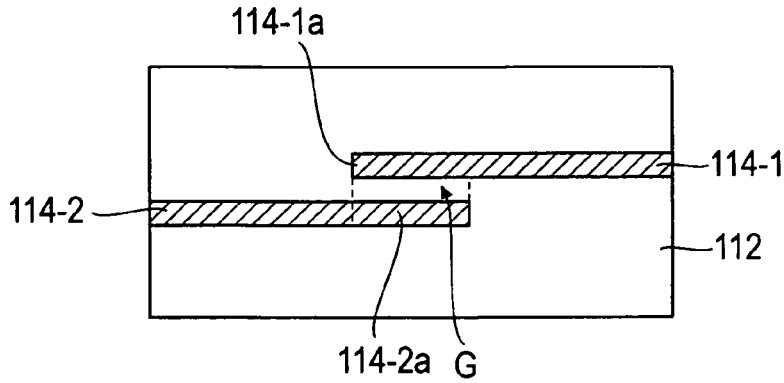
FIG. 6B is a view showing a different application of that system.

FIG. 6B is a plan view showing the instance in which the configuration of FIG. 6A is applied to a microstrip line.

Figure 7A:
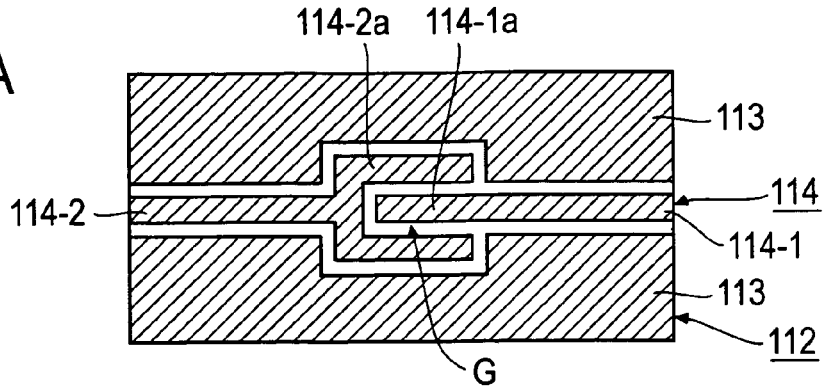
FIG. 7A is a view showing a fourth example of the coupled transmission line system according to the present invention in which the end portion of one of the line conductor sections is embraced by the other line conductor section.

FIG. 7A illustrates still another modified form of the coupled transmission line system, as a fourth example, which is applied to a coplanar line. In FIG. 7A the parts that are similar to like parts in FIG. 4A are indicated by like reference numerals and character.

Figure 7B:
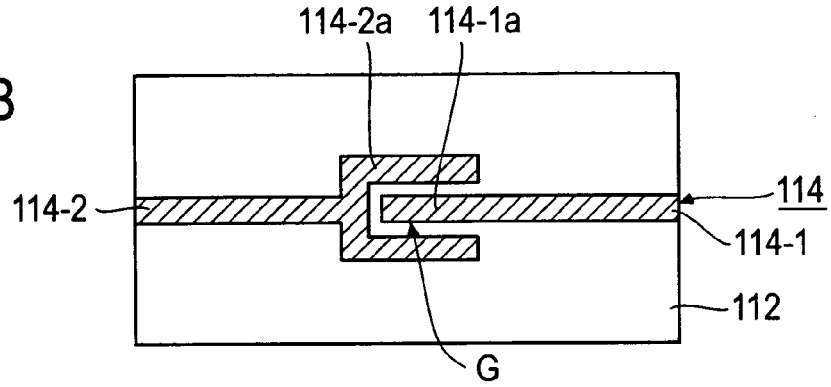
FIG. 7B is a view showing a different application of that system.

FIG. 7B is a plan view showing the instance in which the configuration of FIG. 7A is applied to a microstrip line. In FIG. 7B the parts that are similar to like parts in FIG. 4A are indicated by like reference numerals and character.

Figure 8A:
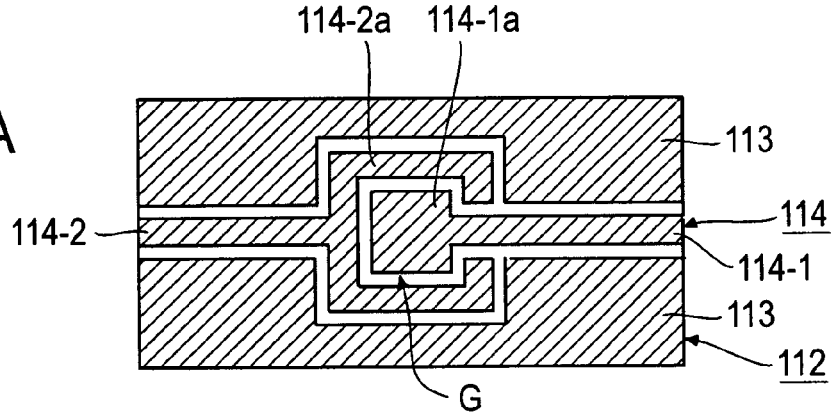
FIG. 8A is a view showing a fifth example of the coupled transmission line system having a modified form of the configuration in which the end portion of one of the line conductor sections is embraced by the other line conductor section.

FIG. 8A illustrates yet another modified form of the coupled transmission line system, as a fifth example, which is applied to a coplanar line. In FIG. 8A the parts that are similar to like parts in FIG. 4A are indicated by like reference numerals and character.

Figure 8B:
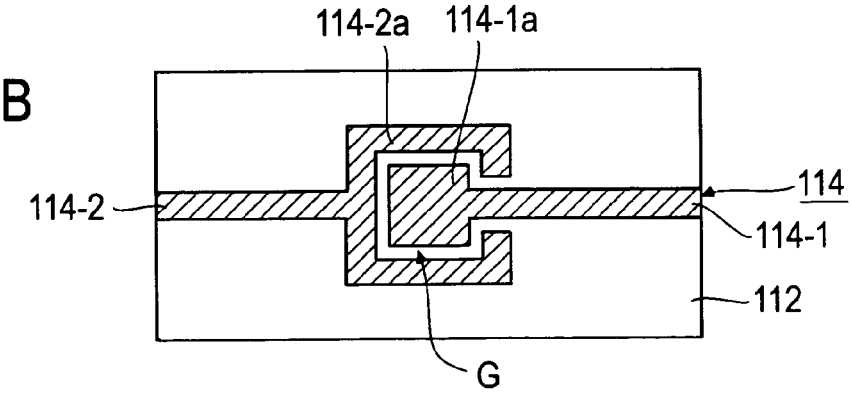
FIG. 8B is a view showing a different application of that system.

FIG. 8B is a plan view showing the instance in which the configuration of FIG. 8A is applied to a microstrip line. In FIG. 8B the parts that are similar to like parts in FIG. 4A are indicated by like reference numerals and character.

Figure 9A:
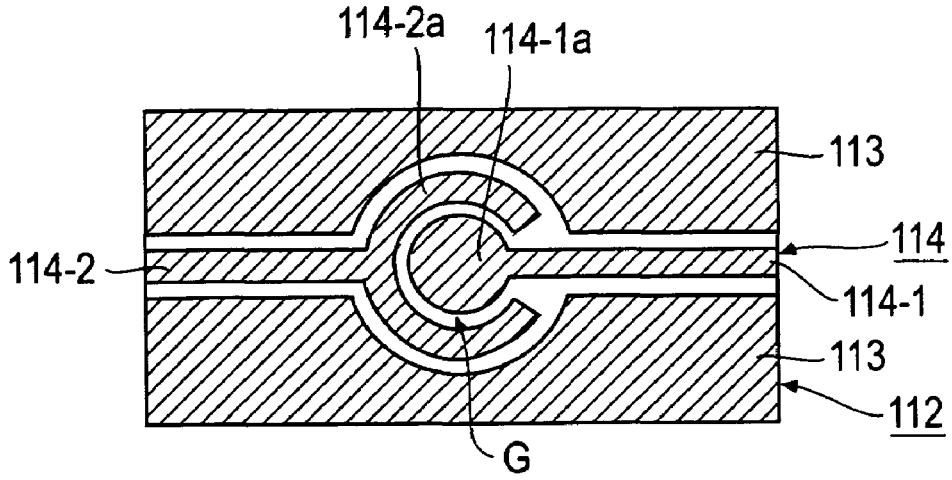
FIG. 9A is a view showing a sixth example of the coupled transmission line system having a further modified form of the configuration in which the end portion of one of the transmission lines is embraced by the other transmission line.

FIG. 9A illustrates another modified form of the coupled transmission line system, as a sixth example, which is applied to a coplanar line. In FIG. 9A the parts that are similar to like parts in FIG. 4A are indicated by like reference numerals and character.

Figure 9B:
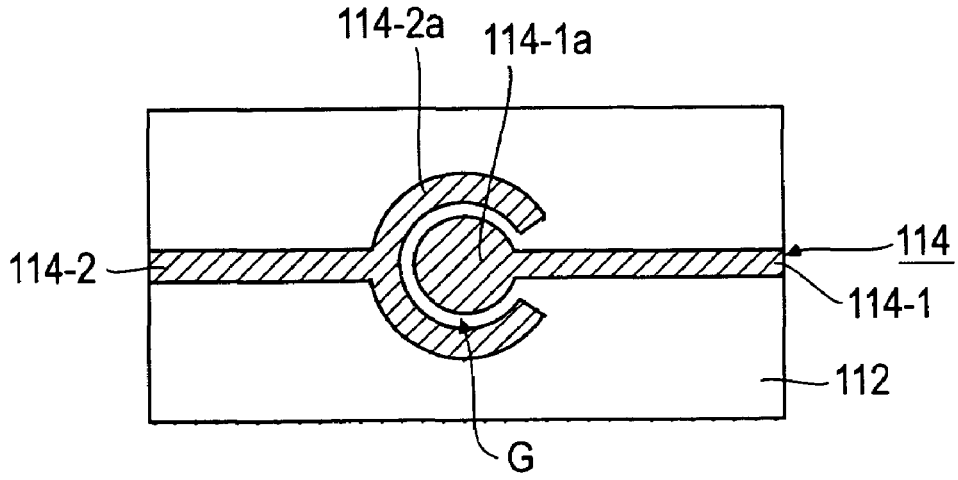
FIG. 9B is a view showing a different application of that system.

FIG. 9B is a plan view showing the instance in which the configuration of FIG. 9A is applied to a microstrip line. In FIG. 9B the parts that are similar to like parts in FIG. 4A are indicated by like reference numerals and character.

FIG. 7A, FIG. 7B, FIG. 8A, FIG. 8B, FIG. 9A and FIG. 9B illustrate the configuration of the coupled transmission line system in which the end portion 114-1*a* of one 114-1 of the opposed line conductor sections is embraced by the opposing end portion 114-2*a* of the other line conductor section 114-2 so that the length of the edge lines of the opposed end portions defining the open gap G therebetween may be increased without substantially increasing the width (transverse dimension) of the opposed portions of the coupled line conductor sections as in the configuration shown in FIG. 4, whereby an increased coupling capacity may be insured.

It should be noted that in the capacitive coupled transmission line system, the configuration in which the edge lines of the opposed end portions defining the open gap are elongated is not limited to those shown in FIGS. 4-9, but various forms other than those shown in FIGS. 4-9 may be envisaged and all such forms will come within the scope of the present invention.

The wavelength varies in accordance with the resonance frequency as well understood, the so called wavelength in the present invention designates not only the theoretical wavelength that is determined by theory but also the effective wavelength that is determined from various component factors adopted according to the circuit design. For instance, when the resonance frequency is 5 GHz, the theoretical wavelength becomes approximately 6 cm, but if the dielectric substrate of coplanar line filter is made by MgO whose thickness is 0.5 mm, the effective wavelength becomes from 2.5 to 2.6 cm. Apparently, the circuitry is to be designed by using the effective wavelength.

First Embodiment

Figure 10:
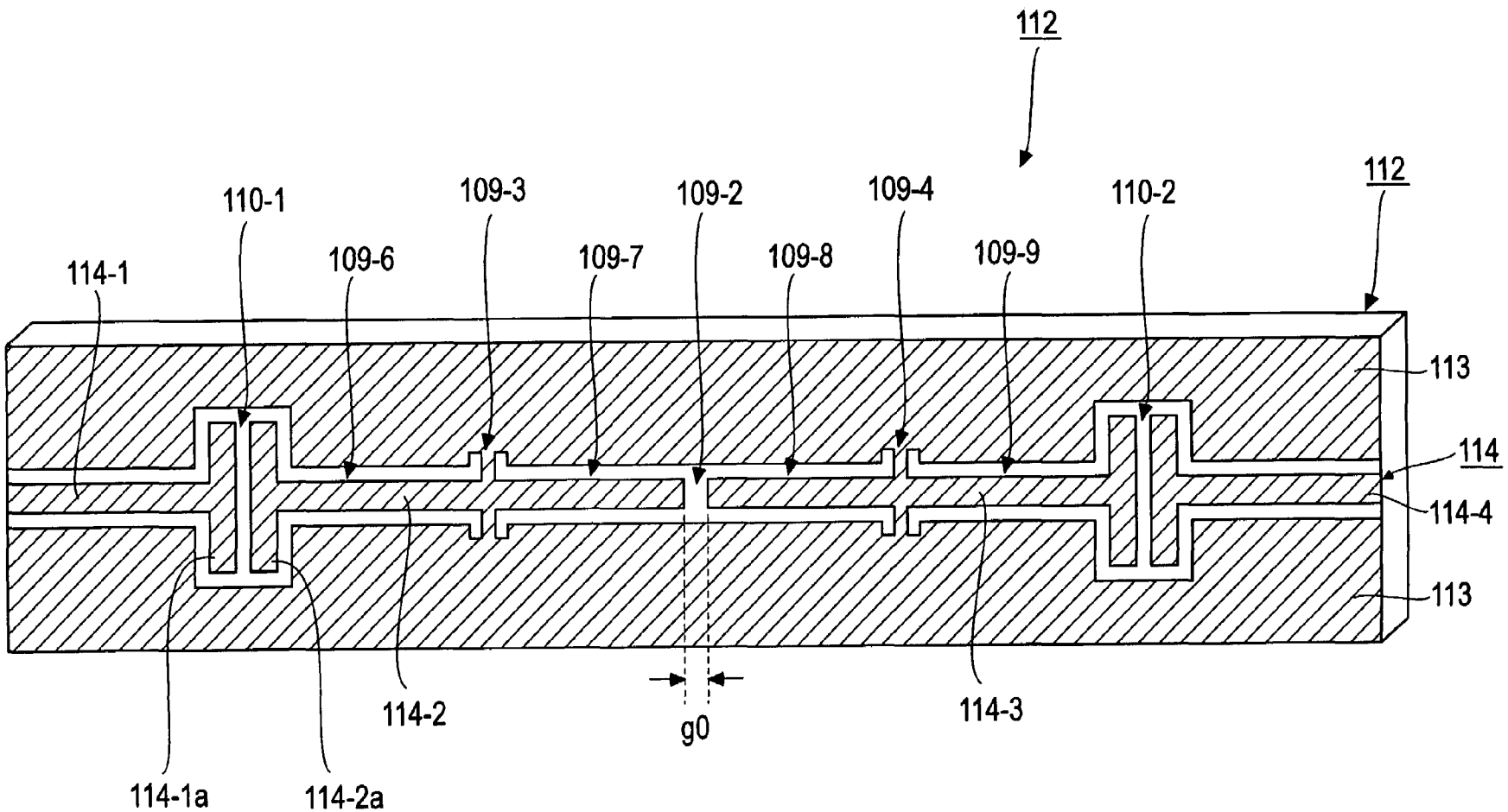
FIG. 10 is a view showing a first embodiment of the coplanar line filter with four-stage λ/4 resonators using the coupled transmission line system of the present invention.

A first embodiment of the filter according to the invention set forth in claim 1 is shown in a plan view in FIG. 10, in which the parts that are similar to like parts in FIGS. 4-9 are indicated by like reference numerals and character. The principal specifications of the filter of the first embodiment illustrated here which is a Chebyshev four-stage bandpass coplanar line filter are as shown in Table 1.

TABLE 1

| The principal specifications of the filter | |
|---|---|
| Center frequency | 5 GHz |
| Band width | 160 MHz |
| Ripple amplitude within the band | 0.01 dB |

While in this first embodiment of the filter the numerical values in the table 1 are indicated by way of example, it is needless to say that the filter may be designed with arbitrarily selected center frequency, band width and ripple amplitude within the band.

This filter 108 is a distributed constant type filter and comprises capacitive coupling sections 110-1 and 110-2 as illustrated as the first example of the coupled transmission line system in FIG. 4 disposed adjacent the input and output ends, respectively of the filter, and four resonators 109-6, 109-7, 109-8, 109-9 arranged between the capacitive coupling sections, all being formed on a dielectric substrate 112. A capacitive resonator coupling section 109-2 having a certain open gap width g0 being provided between the second and third resonators 109-7, 109-8 and inductive resonator coupling sections 109-3 and 109-4 including short-circuited stubs having a certain length and width are joined between the first and second resonators 109-6, 109-7 and between the third and fourth resonators 109-8, 109-9, respectively. In this manner, the first to fourth resonators are series connected by alternating capacitive resonator coupling section 109-2 and inductive resonator coupling sections 109-3 and 109-4 to form a coplanar line.

Each of the resonators 109-6, 109-7, 109-8 and 109-9 is designed so as to be λ/4 in length taking into account the influences exerted by the coupling sections at the opposite ends.

Since the capacitive coupling sections 110-1 and 110-2 at the input and output ends of the filter are particularly required to have a stronger coupling than that of the capacitive resonator coupling section 109-2, the coupled transmission line system shown in FIG. 4 is applied to insure an adequate coupling capacity.

Figure 2:
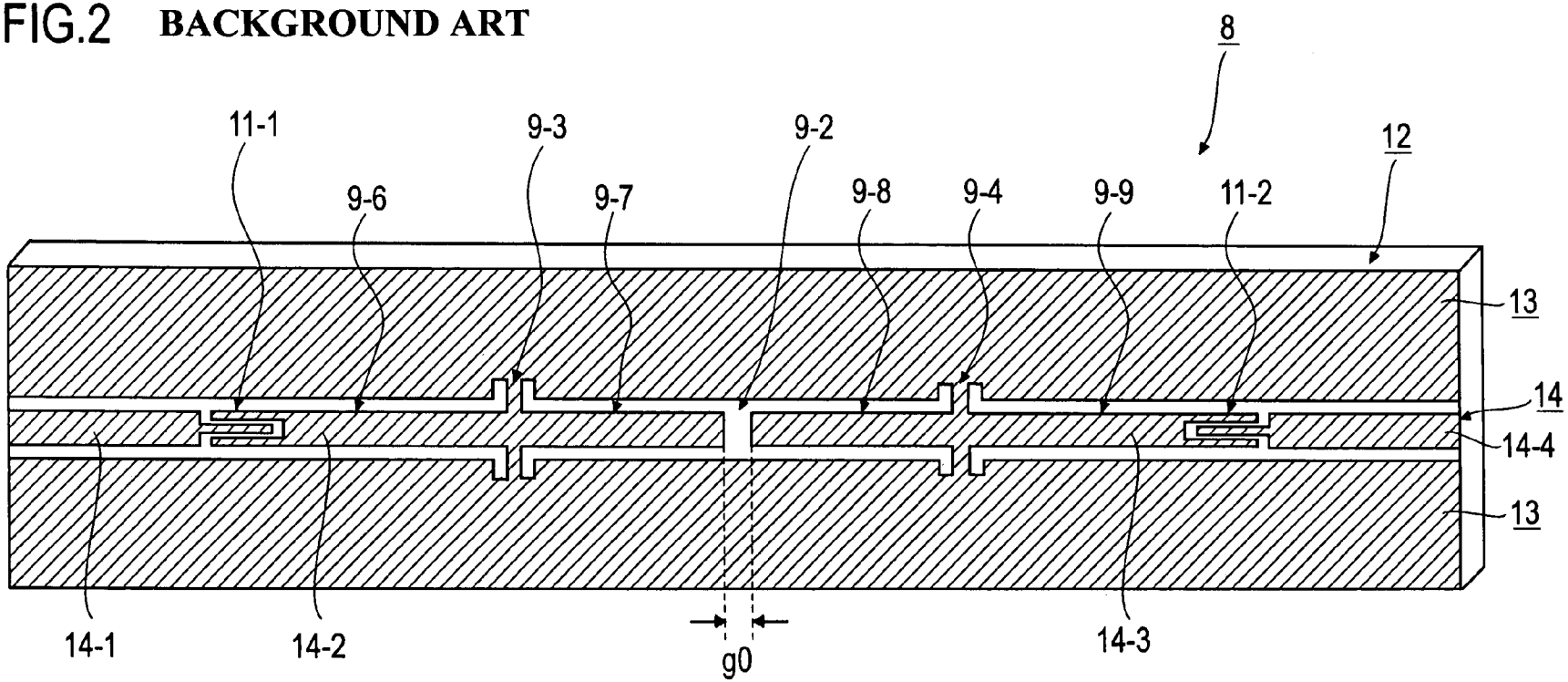
FIG.2 BACKGROUND ART
FIG. 2 is a view showing a prior art coplanar line filter with four-stage λ/4 resonators using the coupled transmission line system.

It should be noted here that the coplanar line filter 8 with four-stage λ/4 resonators shown in FIG. 2 using the prior art coupled transmission line system shown in FIG. 1 and the coplanar line filter 108 shown in FIG. 10 which is an embodiment of the present invention may have almost completely equal filtering characteristics by both being designed as a coupled transmission line system having an equal inverter value.

Figures 11A, 11B, 11C, 11D:
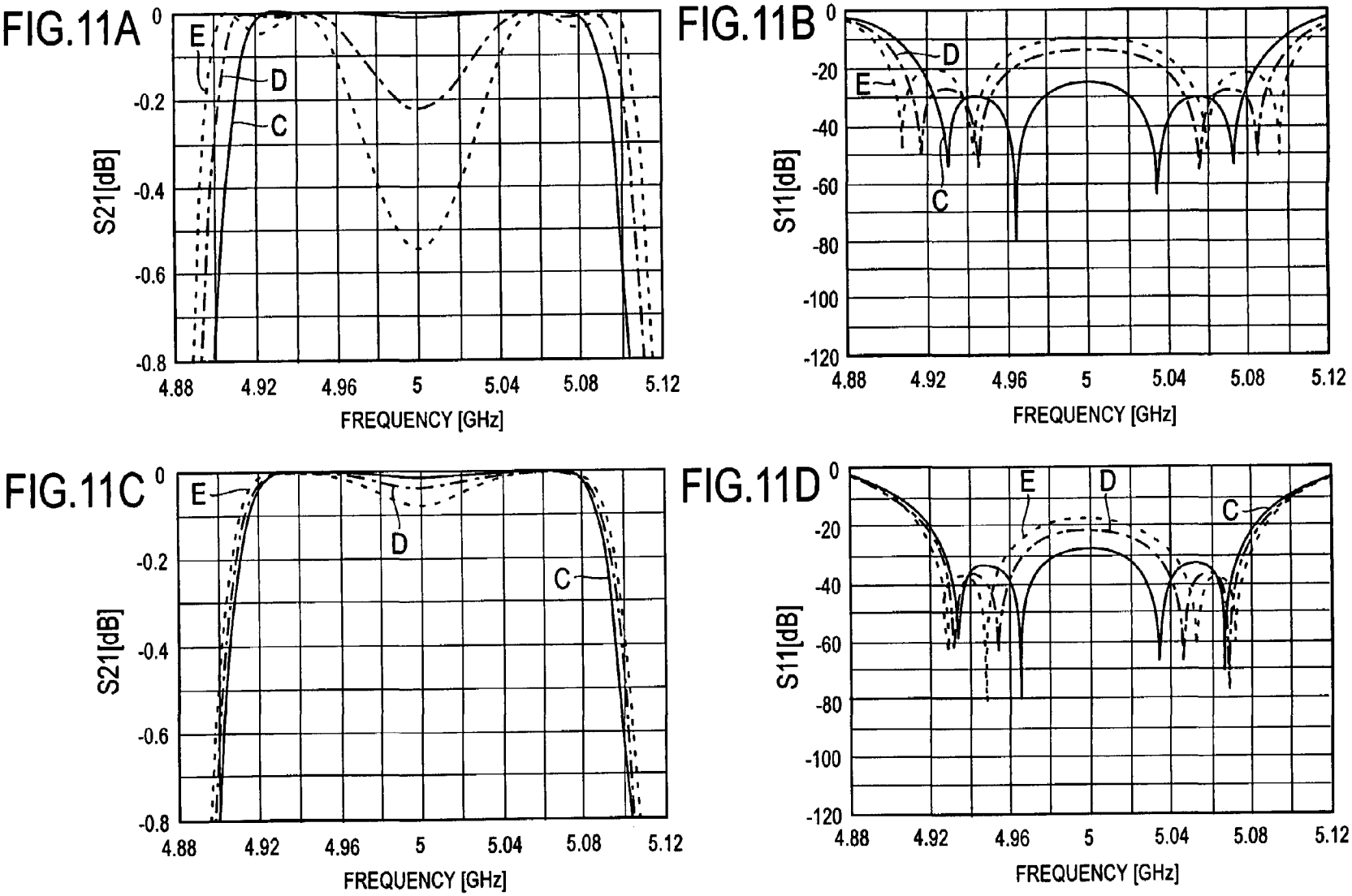
FIG. 11A is a graph showing the variations in the transmission characteristics (S21) of the prior art filter due to dimensional errors involved during the manufacture.
FIG. 11B is a graph showing the reflection characteristics (S11) of the prior art filter.
FIG. 11C is a graph showing the transmission characteristics (S21) of the filter of the present invention due to dimensional errors involved during the manufacture.
FIG. 11D is a graph showing the reflection characteristics (S11) of the filter of the present invention.

Comparison between these two filters is made with respect to the amount of degradation in the filtering characteristics due to dimensional errors. Computer simulations on the equivalent circuits of those filters were conducted on the basis of the inverter values of the coupled transmission line systems when the dimensional errors due to overetching during the manufacturing processes were 0 μm, 4 μm and 8 μm (corresponding to the curves C, D and E, respectively in FIG. 11). The results of the simulations are shown in FIG. 11. If the dimensional errors due to overetching during the manufacturing processes were 8 μm, for instance, the prior art filter 8 exhibited a degradation of up to slightly over 0.5 dB in the insertion loss and an expansion of 40 MHz in the band width as shown in FIG. 11A and an reflection loss within the band to less than 10 dB as shown in FIG. 11B. In contrast, the filter 108 according to this invention exhibited a degradation of less than 0.1 dB in the insertion loss with little change in the band width as shown in FIG. 11C and an reflection loss within the band to slightly less than 20 dB as shown in FIG. 11D. It is thus to be appreciated that the firmness of the filtering characteristics against the dimensional errors involved in manufacture may be greatly enhanced by designing and manufacturing the filter by adapting the coupled transmission line system of the present invention for the input and output ends of the filter.

Other embodiments of the filter including those in which microstrip lines are used as a transmission line structure and in which the length of the resonator is an integral multiple of the half-wavelength will be described below.

Second Embodiment

Figure 12:
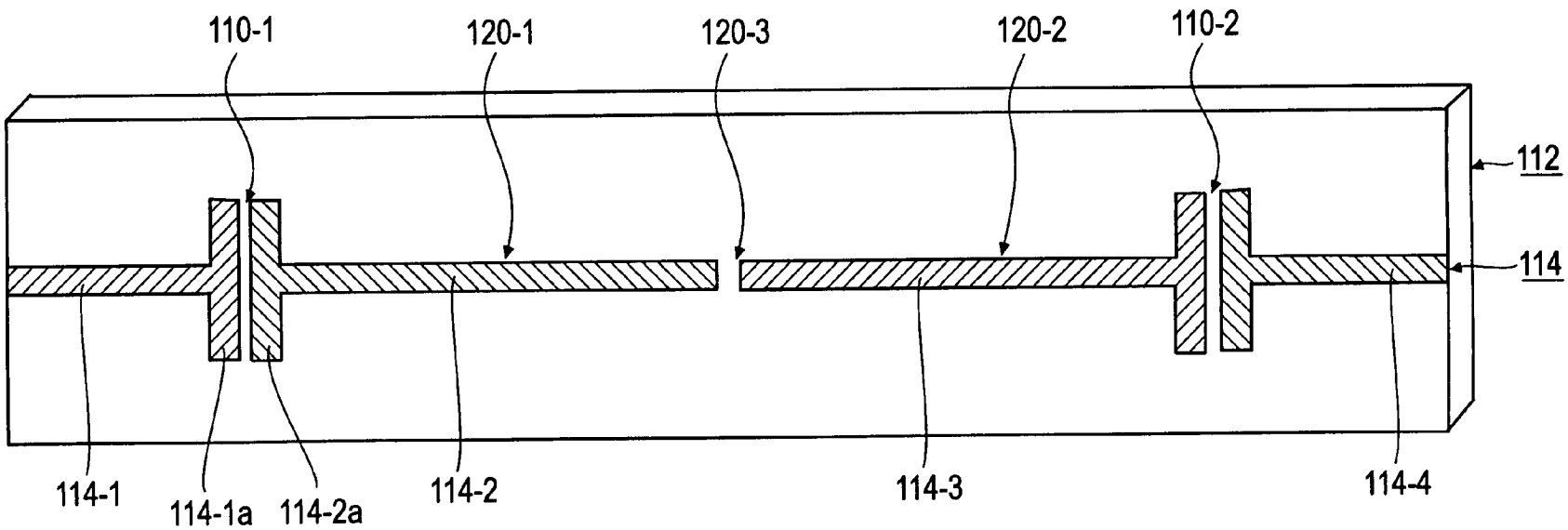
FIG. 12 is a view showing a second embodiment of the filter of the present invention comprising n λ/2 resonators (n is a natural number) constructed in the form of a microstrip line.

FIG. 12 illustrates a second embodiment of the filter in the form of a microstrip line comprising a plurality of the capacitive coupled transmission line systems 110 as shown in FIG. 4 (two line systems 110-1 and 110-2 disposed at the input and output ends, respectively in the example shown) and a plurality of resonators (two resonators 120-1 and 120-2 in this example) interposed between the coupled transmission line systems, the resonators each having a length equal to an integral multiple of λ/2 and being coupled by means of a capacitive resonator coupling section 120-3.

Third Embodiment

Figure 13:
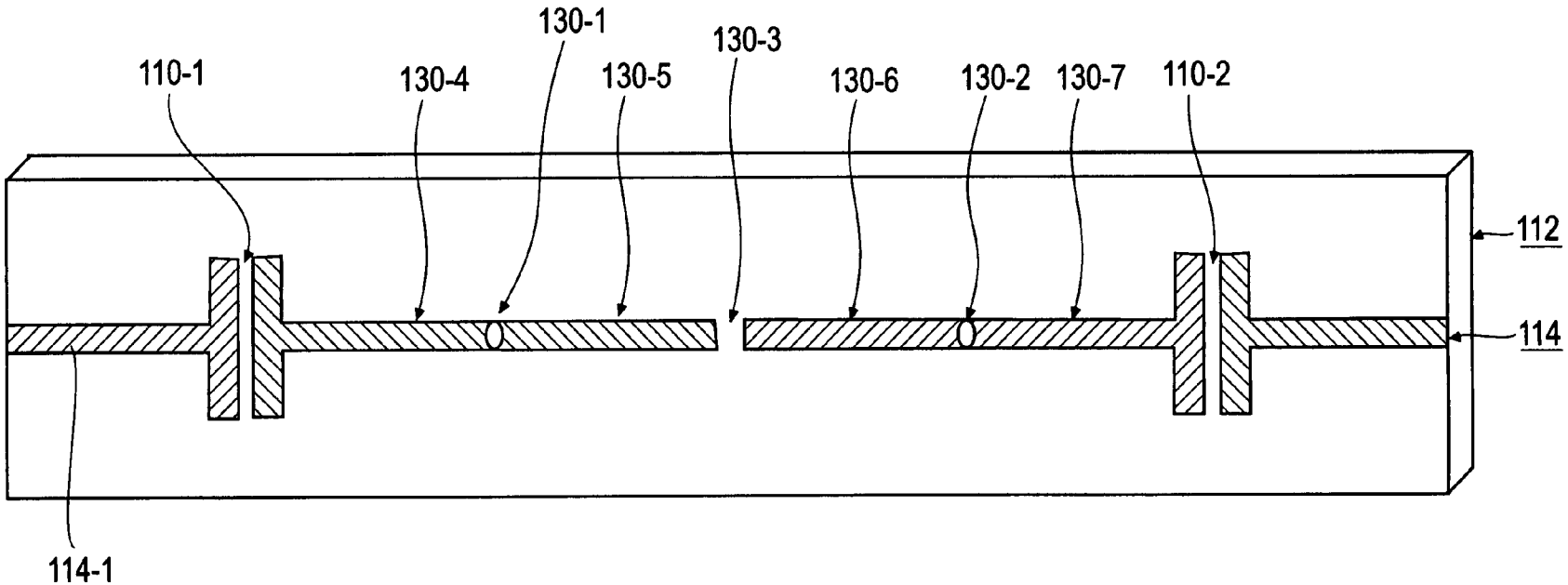
FIG. 13 is a view showing a third embodiment of the filter of the present invention comprising (2n−1) λ/4 resonators (n is a natural number) constructed in the form of a microstrip line.

FIG. 13 illustrates a third embodiment of the filter in the form of a microstrip line comprising two capacitive coupled transmission line system 110-1 and 110-2 as shown in FIG. 4 disposed at the input and output ends, respectively and a plurality of resonators (four resonators 130-4, 130-5, 130-6 and 130-7 in this example) interposed between the coupled transmission line systems 110-1 and 110-2, the resonators each having a length equal to an odd multiple of λ/4 and the first and second resonators 130-4 and 130-5 and the third and fourth resonators 130-6 and 130-7 being coupled by means of inductive resonator coupling sections 130-1 and 130-2, respectively comprising via-holes and the second and third resonators 130-5 and 1306 being coupled by a capacitive resonator coupling section 130-3.

Fourth Embodiment

Figure 14:
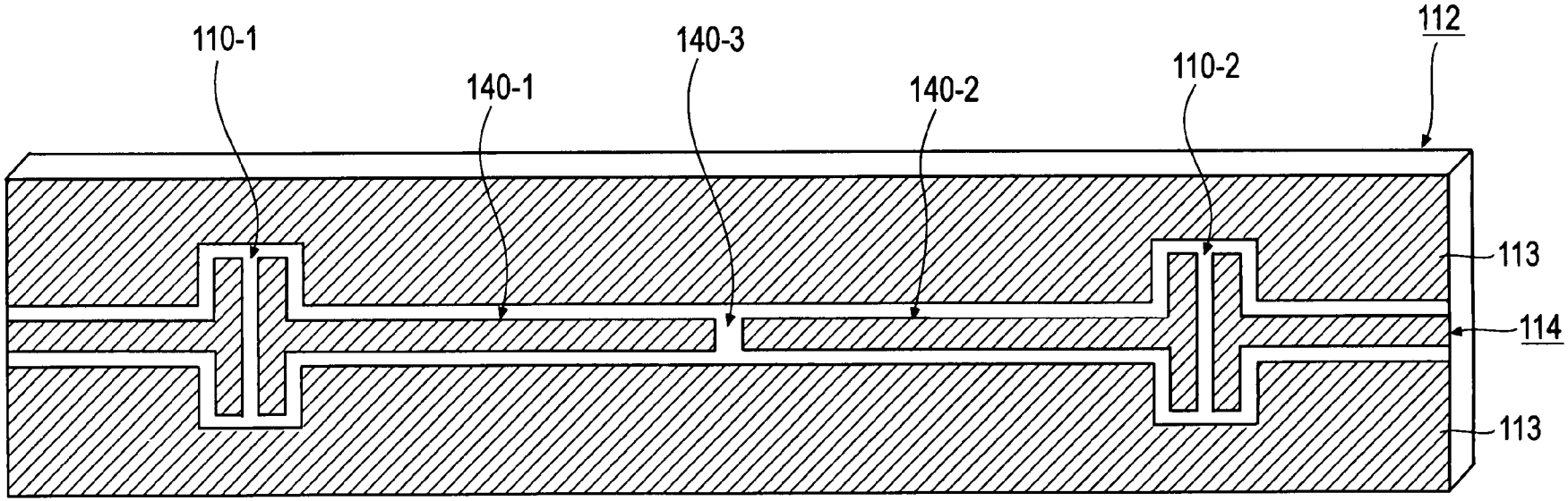
FIG. 14 is a view showing a fourth embodiment of the filter of the present invention comprising n λ/2 resonators (n is a natural number) constructed in the form of a coplanar line.

FIG. 14 illustrates a fourth embodiment of the filter in the form of a coplanar line comprising capacitive coupled transmission line systems 110-1 and 110-2 as shown in FIG. 4 disposed at the input and output ends, respectively and a plurality of resonators (two resonators 140-1 and 140-2 in this example) disposed between the coupled transmission line systems, the resonators each having a length equal to an integral multiple of λ/2 and being coupled by means of a capacitive resonator coupling section 140-3.

While the foregoing embodiments are described in association with a filter having capacitive coupled transmission line systems 110-1 and 110-2 as shown in FIG. 4 disposed at the input and output ends, respectively, it is also possible to use the capacitive coupled transmission line systems as shown in FIGS. 5-9 and other types of capacitive coupled transmission line systems which do not depart from the scope of the present invention.

Fifth Embodiment

Figure 15:
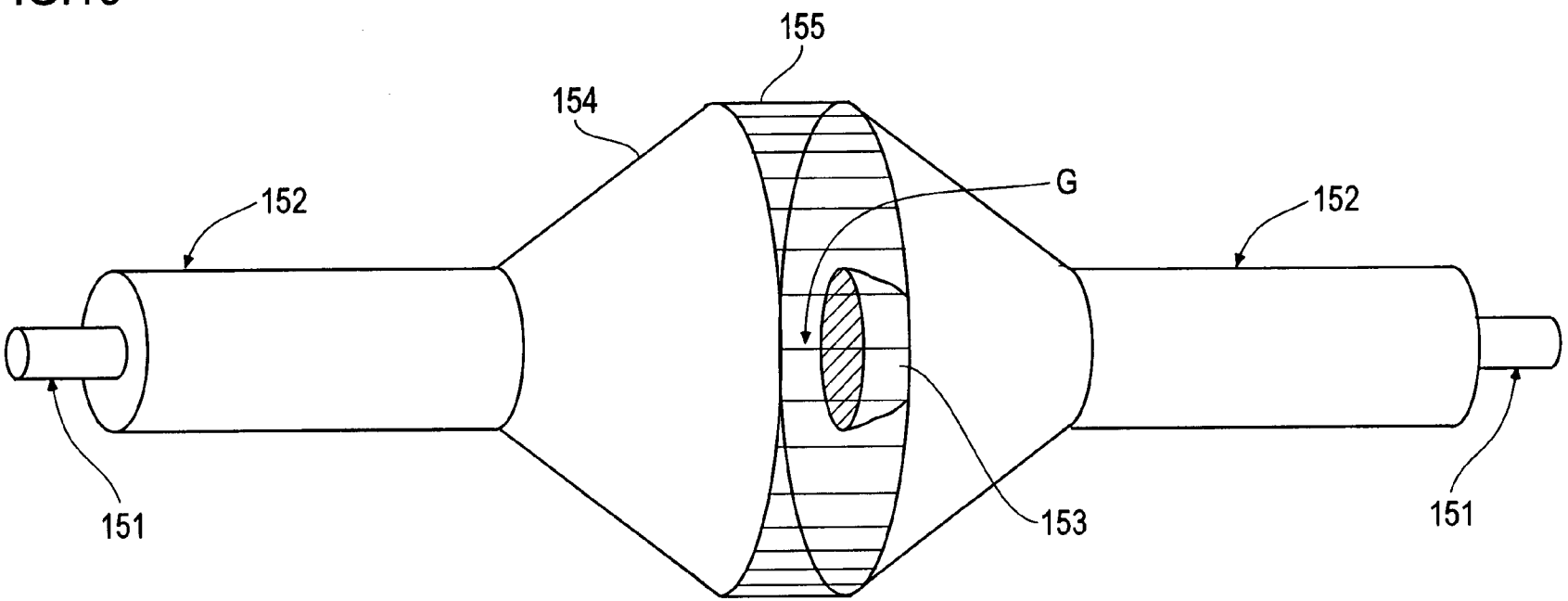
FIG. 15 is a view showing a seventh example representing an application of the coupled transmission line system to a coaxial line.

While the foregoing embodiments are described as being limited to a planar circuit only, the configuration of the coupled transmission line system and the filter may be applied to a three-dimensional system. For example, the coupled transmission line system of FIG. 5 may be also applicable to a construction as shown in FIG. 15 utilizing a coaxial line (which may be called a seventh example of the coupled transmission line system). In this case, the line conductor may comprise a center conductor 151 of the coaxial line, the ground conductor may comprise an outer conductor 152 of the coaxial transmission line, and the dielectric substrate may comprise a cladding of the coaxial line. The opposed end portions 153 of two conductor sections are formed in the shape of a cone and are separated from each other by an open gap G. The outer conductor 152 also include opposed funnel-shaped portions 154 surrounding the corresponding end portions 153 of the conductor sections and connected by outer conductor 155 (explained inner space by a wire frame 155, for example). This coupled transmission line system may be used for input and output ends of a filter likewise formed in a three-dimensional configuration.

The respective coupling section used in the filter of the above embodiments is either called as the capacitive coupling section or the inductive coupling section depending upon either capacitive coupling property or inductive coupling property is superior to the other, respectively. It should be, thus understood that the respective coupling section used in the filter of the present invention are not restricted to alternate their types of coupling. In other words, the respective coupling section may be either capacitive coupling type or inductive coupling type that is stronger in one type than the other.

Further, it is possible to use a superconductor as a conductor for the transmission line and the ground. The use of a high-temperature superconductor, among others, having a boiling point above 77.4 K which is the boiling point of liquid nitrogen makes it possible to reduce the power requirements of cooling systems and downsize the circuit scale. This type of superconductor may include copper oxide superconductors such as Bi-based, Ti-based, Pb-based and Y-based copper oxides and the like, all of which are usable and may well contribute to reducing the insertion loss of the filter as well as enhancing its selectivity.

INDUSTRIAL APPLICABILITY

The filter according to the present invention may be utilized as a key device in microwave and millimeter band communications.

What is claimed is:

1. A filter comprising:

a line conductor;

a ground conductor disposed in opposing relation to the line conductor;

a dielectric interposed between the line conductor and the ground conductor;

the line conductor including first and second line conductor sections provided on a surface of the dielectric in a symmetrical pattern, the line conductor sections having opposed portions separated from each other by an open gap to form a capacitive coupling section therebetween, each of said opposed portions of said first and second line conductor sections substantially elongated from opposing sides of a corresponding line conductor section, each of said opposed portions having a length in a widthwise direction longer than the line width of the corresponding line conductor sections;

said capacitive coupling section providing input and output ends of the filter; and a plurality of resonators coupled between said capacitive coupling section at the input and output ends of the filter, each of said resonators having a length equal to an integral multiple of $\lambda/4$.

2. A filter comprising:

a line conductor;

a ground conductor disposed in opposing relation to the line conductor;

a dielectric interposed between the line conductor and the ground conductor;

the line conductor including first and second line conductor sections provided on a surface of the dielectric in a symmetrical pattern, the line conductor sections having opposed portions separated from each other by an open gap to form a capacitive coupling section therebetween, each of said opposed portions of said first and second line conductor sections substantially elongated from opposing sides of a corresponding line conductor section, each of said opposed portions having a length in a widthwise direction longer than the line width of the corresponding line conductor sections;

said capacitive coupling section providing input and output ends of the filter; and a plurality of resonators coupled between said capacitive coupling section at the input and output ends of the filter, each of said resonators having a length equal to an integral multiple of $\lambda/4$, wherein said plurality of resonators are series connected by alternating capacitive resonator coupling sections and an inductive resonator coupling section, said inductive coupling section including a short-circuited stub having a predetermined length and width.

3. A filter comprising:

a line conductor;

a ground conductor disposed in opposing relation to the line conductor; and a dielectric interposed between the line conductor and the ground conductor, wherein the line conductor includes first and second line conductor sections provided on a surface of the dielectric in a symmetrical pattern, the line conductor sections having opposed portions separated from each other by an open gap to form a capacitive coupling section therebetween, each of said opposed portions of said first and second line conductor sections is substantially elongated from opposing sides of a corresponding line conductor section, each of said opposed portions having a length in a widthwise direction longer than the line width of the corresponding line conductor sections, and each of said opposed portions extend from the corresponding line conductor sections and taper toward the corresponding edge lines such that the opposed portions are increased in the line width.

* * * * *